US005232165A

United States Patent [19]

Tournier

[11] Patent Number: 5,232,165

[45] Date of Patent: Aug. 3, 1993

[54] SPRINKLING DEVICE FOR SHOWERS

[76] Inventor: Pierre Tournier, Benque, 31430 Le Fousseret, France

[21] Appl. No.: 853,726

[22] PCT Filed: Nov. 27, 1990

[86] PCT No.: PCT/FR90/00859

§ 371 Date: Jun. 9, 1992

§ 102(e) Date: Jun. 9, 1992

[87] PCT Pub. No.: WO91/08055

PCT Pub. Date: Jun. 13, 1991

[30] Foreign Application Priority Data

Nov. 27, 1989 [FR] France ..... 89 15572

[51] Int. Cl.[5] ..... B05B 1/34; B05B 1/12; B05B 1/30

[52] U.S. Cl. ..... 239/462; 239/472; 239/491; 239/499; 239/504; 239/515

[58] Field of Search ..... 239/462, 472, 476, 482–485, 239/487, 488, 491, 499, 504, 515, 553

[56] References Cited

U.S. PATENT DOCUMENTS

| | | | |
|---|---|---|---|
| 1,282,175 | 10/1918 | Binks | 239/488 |
| 1,324,579 | 12/1919 | Binks | 239/488 |
| 2,134,347 | 10/1938 | Thompson | 239/487 |
| 2,395,227 | 2/1946 | Lewis et al. | 239/553 |
| 2,945,631 | 7/1960 | Hutchinson | 239/553 |
| 3,104,829 | 9/1963 | Wahlin . | |
| 3,146,674 | 9/1964 | Wahlin . | |

FOREIGN PATENT DOCUMENTS

| | | | |
|---|---|---|---|
| 773968 | 12/1967 | Canada | 239/488 |
| 276057 | 9/1913 | Fed. Rep. of Germany . | |
| 690161 | 9/1930 | France . | |
| 824149 | 2/1938 | France . | |
| 56533 | 9/1952 | France | 239/491 |
| 0582887 | 12/1977 | U.S.S.R. | 239/487 |
| 1152163 | 5/1969 | United Kingdom | 239/487 |

*Primary Examiner*—Andres Kashnikow
*Assistant Examiner*—Karen B. Merritt
*Attorney, Agent, or Firm*—Sandler Greenblum & Bernstein

[57] ABSTRACT

Sprinkling device for installation in showers at the outlet of a water pipe is provided with at least one deflector having a plurality of peripheral vanes of a central spindle which is coaxially mounted in a first, preferably cylindrical, inner chamber. The inner chamber is housed in a socket which is tightly screwed into the end of the water pipe, and has a downward extension formed by a second cylindrical or conical inner chamber which opens onto a calibrated nozzle. A perforated outlet plate can be moved towards or away from the nozzle, and forms the front of a concentric sleeve which is slidably mounted around the socket.

20 Claims, 2 Drawing Sheets

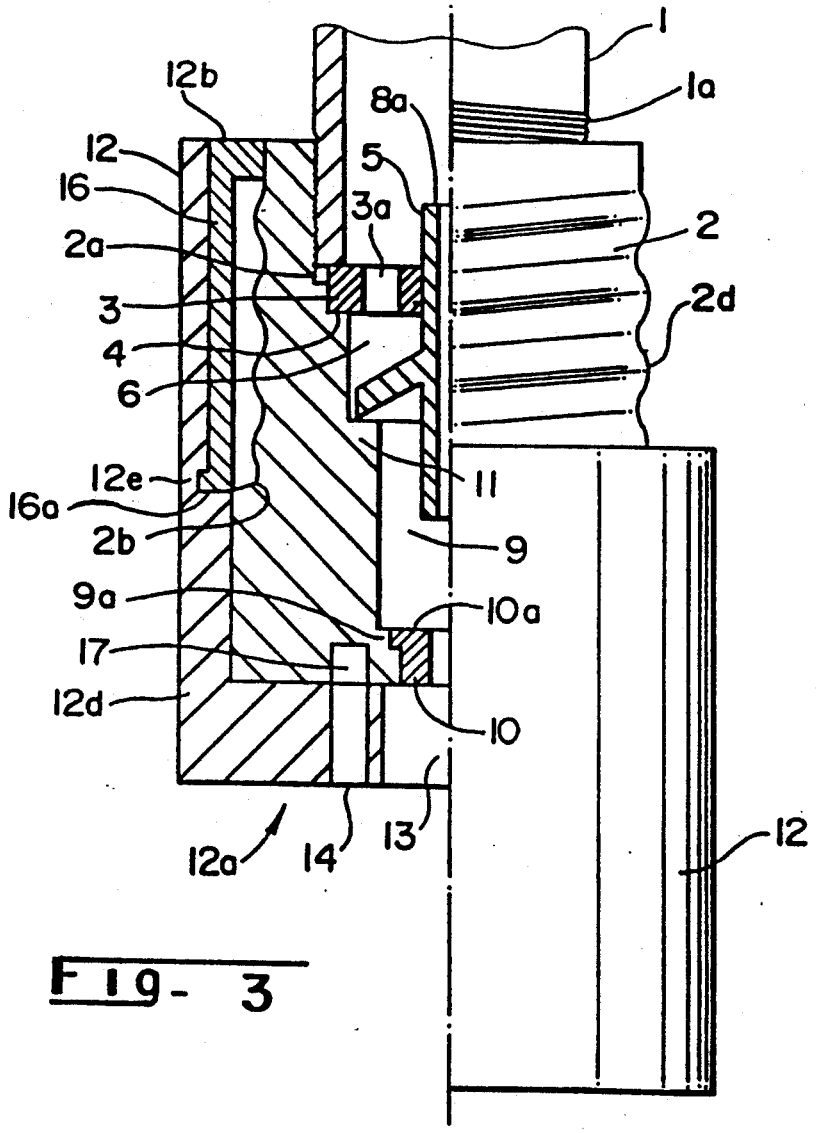
Fig- 3
Fig- 4
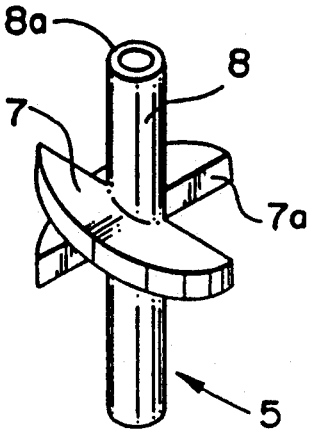
Fig- 5
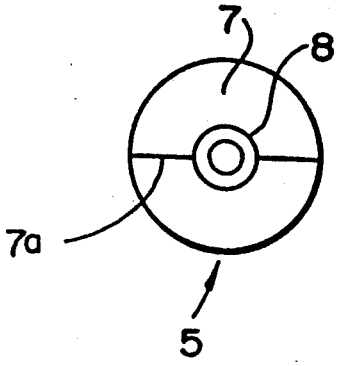

SPRINKLING DEVICE FOR SHOWERS

BACKGROUND OF THE INVENTION

1. Field of the Invention

The present invention is related to a sprinkling device for showers.

2. Discussion of Background Information

A certain number of sprinkling devices are known, that aim, for example, to reduce water consumption by virtue of the adjunction of devices, such as nozzles, limiting water output, or to obtain jets with adjustable force and amplitude. In this regard, the FR-824,149 filed by the company JACOB DELAFON, is notable in that it is related to a device for the dispersion and spraying of water, and is used especially in shower or sprinkler jet devices. This spraying device comprises an inner helical core providing a rotational movement to the liquid jet, the helical core being located in a concentric sleeve, preferably axially mobile, enabling the modification of the free space between the helical core and the movable sleeve, and, consequently, the adjustment of the fineness of the spray. Equivalent devices have also been proposed in the U.S. Pat. No. 3,104,829 or U.S. Pat. No. 3,146,674. The devices disclosed in this patent also comprises a device capable of providing a swirling movement to the liquid jet. so as to obtain adequate agitation of air and water in order to maintain a sprinkling shower at the outlet of the device, comparable to that conventionally obtained while substantially reducing water consumption.

In all of these known devices, it is however, not possible to separately adjust the intensity fineness of the spray of the liquid jet. For example, FR-824,149, the helical core, suggested as the deflector means communicating a rotational movement to the liquid jet, slides coaxially inside a truncated bored sleeve, enabling the simultaneous obtaining of, either a vortex corresponding to a high degree of dispersion and spraying of an intense liquid jet, or an assembly of helical streams of water surrounded by a tapered liquid sheet, without a tangential component, that damps the swirling movement and the degree of fineness of the spray. It is thus impossible to obtain a jet with lesser amplitude, or simply, an intense jet that is not too dispersed, and at the same time keep water consumption at the same level (it would, of course, be possible to increase the intensity of the jet by increasing output). Another disadvantage of this known device is that it is systematically weakened at its center when the jet is dispersed to a maximum, and this constitutes an important disadvantage for a number of users.

SUMMARY OF THE INVENTION

It is an object of the present invention to overcome the above-discussed disadvantages by proposing a sprinkling device adapted for showers, at the level of the outlet of a water pipe, characterized in that it comprises at least one deflector means constituted by a plurality of peripheral vanes of a central spindle located coaxially in a first inner chamber, preferably cylindrical that is arranged in a socket screwed tightly at the end of the water pipe, the first chamber being extended downwardly by a second inner chamber, cylindrical or conical, opening into a calibrated nozzle, a perforated outlet plate being able to be moved towards or away from in front of it, the perforated outlet plate forming the front face of a concentric sleeve, slidably mounted about the socket.

According to the present invention, the position of the calibrated nozzle is thus fixed and the intensification of the swirling jet of water emanating from the upper deflector is, as a result not in any way dependent on the longitudinal position of the concentric sleeve sliding about the socket, and bearing at its end, an outlet plate, perforated with holes whose longitudinal displacement enables the angle of diffusion of the liquid jet to be varied. To this end, when the outlet plate is located closest to the calibrated nozzle, the liquid jet is intense and has maximum amplitude; inversely, when the outlet plate of the sleeve is distanced to a maximum with respect to the fixed calibrated nozzle, the liquid jet coming out of this nozzle hits the internal wall of said sleeve, thus breaking the force of the jet and at the same reducing its amplitude.

Additionally, according to a complementary characteristic of the present invention, the perforated outlet plate forming the front face of the sleeve comprises a central hole, preferably oblong, surrounded by smaller peripheral holes, distributed uniformly about the central hole; in this way, there is a first intermediate position of the sleeve along the socket, in which the diffused liquid jet coming out from the fixed calibrated nozzle only just reaches the limit between the central hole and the peripheral holes of the outlet plate, this first intermediate position determining the limit beyond which the jet is intense. Then, between this first intermediate position and the maximum elongation position of the sleeve along the socket, the liquid jet attains the peripheral holes of the outlet plate, without however, hitting the internal wall of the sleeve, the jet being then diffused more finely and at the same time, having lost its force. Finally, when the sleeve exceeds this second intermediate position, the force of the jet decreases progressively with a quasi-fixed amplitude.

According to another characteristic of the present invention, the deflector means with vanes is either provided with auxiliary means enabling the liquid jet coming out of the nozzle to be fed at its center, and, to this end, the present invention suggests two variations, namely:

each vane of the deflector has a lower scallop promoting the regrouping of some jets of water along a central spindle, the central spindle ending in a tip reconstituting the jets of water into a single central swirling jet with reduced viscosity.

The central spindle of the deflector with vanes is bored longitudinally to form a tube enabling the passage of a nonswirling central flow of water, enabling the jet to be fed directly at its center.

These complementary characteristics of the deflector means with vanes, equivalent insofar as their results are concerned, are not at all detrimental to water economy, procured by the deflector means with vanes upstream from the nozzle. Moreover, the central portion of the liquid jet thus processed, is sufficiently small so as not to influence the behavior of the liquid moving at the periphery, in a swirling movement.

According to yet another characteristic of the invention, the structure of the central portion of the jet is retained all along its path in the sprinkling device since, as has been mentioned previously, the outlet plate is perforated at its center with an oblong hole whose main role is to enable passage of the central portion of the jet without loss of force or deviation.

BRIEF DESCRIPTION OF THE PREFERRED EMBODIMENTS

Other characteristics and advantages of the present invention will become more apparent upon reading the description that follows of the two embodiments given as non-limiting examples of a sprinkling rose device in accordance with the present invention and with reference to the annexed drawings, in which:

FIG. 1 represents two half views, one external, the other a transverse section, of a sprinkling device according to a first embodiment of the invention, FIG. 1*a* is a detailed view of the outlet plate.

FIG. 2 is a perspective view of a first variation of a deflector with vanes used in the sprinkling device represented in FIG. 1, FIG. 3 represents two half views, one external, one in a transverse section, of a second embodiment of a sprinkling device in accordance with the present invention, FIG. 4 is a perspective view of the deflector with vanes used in the sprinkling device represented in FIG. 3, FIG. 5 is a top view of the deflector represented in FIG. 4.

DETAILED DESCRIPTION OF THE PREFERRED EMBODIMENTS

Figure 1:
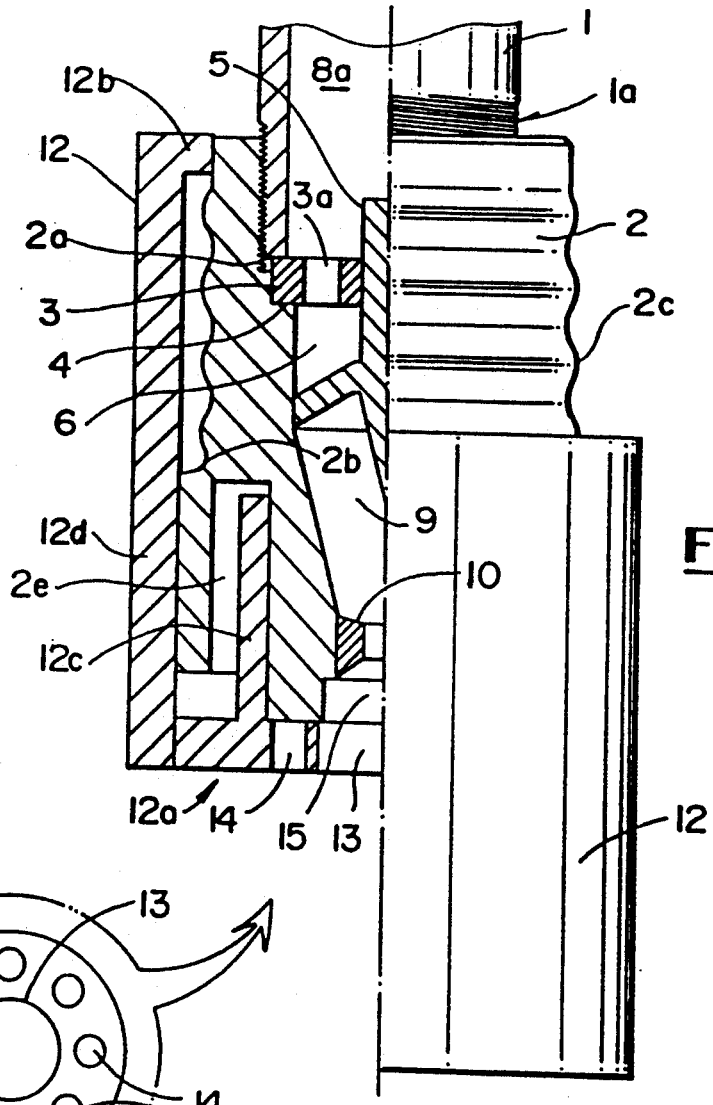

Initially, the common parts of the two embodiments of the invention, such as represented in FIGS. 1 and 3 will be described. In particular, the sprinkling device according to the invention, mounted at the end of a water pipe 1 so as to constitute a shower device, comprises a cylindrical, hollow socket 2 provided, in its upper portion, with an inner threading 2*a*, adapted to be screwed tightly on the outer threading 1*a* of pipe 1. This socket 2 acts as an assembly body to a group of elements, including:

stop means for foreign body transported by the water coming from pipe 1, constituted by a strainer 3, whose holes 3*a* have a calibration determined by the size of the grains of sand dirt, pieces of limestone or tartar that are to be stopped. This strainer 3 is placed at the lower end of inner threading 2*a* of socket 2, in positive support on annular bank 4, internally offset with respect to the threading 2*a*; the depth of this annular bank 4 is less than the thickness of the cylindrical strainer 3, so that the latter can act as a sealing joint between water pipe 1 and socket 2.

Deflector means 5, capable of creating swirling jets of water modifying the apparent viscosity of the fluid, and resulting in water economy. This deflector means 5 is located in a first cylindrical inner chamber 6, having a diameter equal to the inner diameter of annular bank 4.

Figure 2:
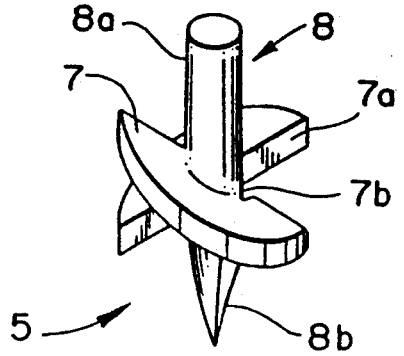

In accordance with FIGS. 2, 4 and 5, the deflector means 5 is constituted by a plurality of peripheral vanes 7 of a central spindle 8, co-linear with respect to the symmetrical axis of cylindrical socket 2. The vanes 7 are inclined vertically at an angle of approximately 45°, and succeed each other regularly from the top to the bottom of central spindle 8.

Additionally, each of vanes 7 has an upper edge 7*a*, all the edges 7*a* defining a same vertical plane (passing, moreover, through central spindle 8). In this manner, the fluid having passed through cylindrical strainer 3, slides on vanes 7 that communicate a swirling movement to this fluid agitate it with air contained in inner chamber 6. It is noted, that, in fact, no addition of air is made, contrary to certain known devices aiming to economize water. It must also be noted that the upper portion 8*a* of central spindle 8 maintains the deflector means 5 on the symmetrical axis of inner chamber 6 by virtue of a hole perforated at the center of the strainer 3. Moreover, the provision of the height of this chamber 6 is done in such a way so as to provide a slight longitudinal clearance to deflector means 5, thus slowing down its encrustation which would be quicker if such deflector 5 were fixed.

According to the variation of the invention represented in FIGS. 1 and 2, each vane 7 has a lower scallop 7*b* encouraging the regrouping of swirling jets of water along the central spindle 8, ending, however, in a tip 8*b* reconstituting the jets into a single central swirling jet, enabling the jet to be fed at its center.

In this embodiment, the first inner chamber 6 is extended downstream by a second truncated inner chamber 9, shrinking progressively downwardly to act as a housing to a removable nozzle 10 adapted to increase the force of the swirling jet, which has been caused to swirl by deflector means 5. This nozzle 10, that also increases the diffusion of the jet, is calibrated according to the maximum water output desired. Due to the fact that it is mounted removably at the base of truncated inner chamber 9, nozzle 10 can be replaced easily, and this enables its inner diameter to be adapted to the pressure available on the water distribution network.

In the embodiment represented in FIGS. 3, 4, and 5, the central spindle 8 of deflector 5 is longitudinally bored so as to be tube-shaped, enabling passage of a central flow of water not affected by the swirling movement communicated to the peripheral flow by vanes 7. This arrangement also enables the jet to be fed at its center, the central non-swirling jet exiting at the base of the tube being directed towards removable nozzle 10, also calibrated according to the maximum water output desired. It will be noted that in this embodiment, the second inner chamber 9 is not truncated but simply cylindrical, the deflector means 5 thus coming into support on shoulder 11 separating the two inner chambers 6 and 9. In this variation, nozzle 10 takes support by a shoulder 10*a* on a bank 9*a* arranged about an opening provided at the center, and in the base of the inner cylindrical chamber 9.

Additionally, it is to be noted that the bore arranged in nozzle 10 can either, as represented in FIG. 1, be composed of two truncated portions surrounding a central cylindrical portion, determining its minimum diameter (Venturi effect), or, as represented in FIG. 3, be constituted of a single cylindrical portion having a constant diameter.

According to the invention, and in a manner common to the two above-cited embodiment, a sleeve 12 is slidably mounted on socket 2 and enables the intensified swirling jet exiting from nozzle 10 to be more or less widely diffused by a perforated outlet plate 12*a* forming the front face of the sleeve 12.

Figure 1A:
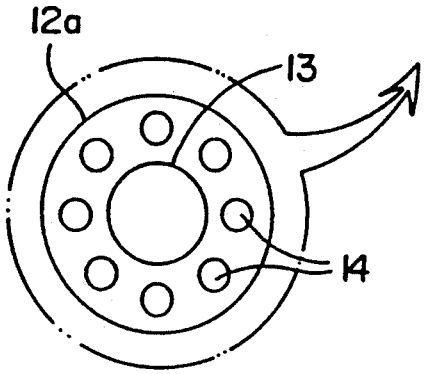

According to the detail represented in FIG. 1*a*, this outlet plate 12*a* comprises a central hole 13, preferably circular or oblong, that is surrounded by smaller peripheral holes 14 uniformly distributed about the central hole 13. According to the invention, the outlet plate 12*a* has sufficient thickness in order for the wall of the central hole 13 to constitute a guide for the intensified swirling jet emanating from nozzle 10. In this way, sleeve 12 has a position along socket 2 for which the water jet has a minimal angular opening and a maximal force; inversely, when according to the external right half views of FIGS. 1 and 3, sleeve 12 is in maximum elongation towards the base, the intensified swirling jet emanating from nozzle 10 can attain peripheral holes 14, enabling the liquid jet exiting from outlet plate 12*a* to lose its force. In this low position, sleeve 12 comes in abutment, by an annular claw 12*b* located in internal offset at its peak, against a projecting annular shoulder 2*b* arranged to this end along socket 2.

In the embodiment represented in FIG. 1, socket 2 is grooved, the grooves 2*c* providing successive, annular notches cooperating with annular claw 12*b*. For this end, the annular claw 12*b* can be formed by a continuous flange, or by a more or less regular succession of lugs, with the manufacturing choice of the claw 12*b* depending on how firm the blockage need be. Once blocked into position, sleeve 12 can then rotate freely about socket 2, annular claw 12*b* being displaced with very little rubbing in annular groove 2*c* in which it is located. In this same embodiment, socket 2 is provided at its lower end with an annular bore 2*e* that cooperates, for the centering of sleeve 12 with an annular ring 12*c* extending towards the inside of the sleeve 12 with respect to the perforated outlet plate 12*a*. The guiding of sleeve 12 is also ensured by the rubbing contact of its internal wall on the external wall of the socket 2. Additionally, according to another characteristic of this embodiment of the invention, the perforated outlet plate 12*a* forms, with ring 12*c*, an integral piece, that is attached at the front of sleeve 12 after socket 2 has been tightly screwed on the external threading 1*a* of water pipe 1. To this end, a housing 15, capable of receiving a tightening key (for example, a hexagonal key), is provided beneath nozzle 10, and contributes moreover to its maintenance. In this way, socket 2 can be tightly screwed onto threading 1*a*, and then sleeve 12 can be closed at its end, by adhering, by masking or in any other way, the element formed by the outlet plate 12*a* and ring 12*c*.

In another variation represented in FIG. 3, socket 2 is threaded rather than grooved, the threads 2*d* cooperating with the annular claw 12*b* of sleeve 12, that can then be displaced along socket 2 by rotation. However, it is provided that annular claw 12*b* has adequate elasticity in order that sleeve 12 can simply be pulled along socket 2, threads 2*d* thus comprising, in the manner of grooves 2*c*, a grooved socket 2 (FIG. 1). To this end, it is clearly evident that the inclination of threads 2*d* of threaded socket 2 can be sufficiently small so that the differences with an assembly of adjacent grooves 2*c* are negligible. In this variation, the mounting method chosen for the shower device is different: outlet plate 12*a* here forms an integral element with the cylindrical body 12*d* (FIG. 1) of sleeve 12, an upper clip 16 of the type having movable arms and being cylindrical, being nested in the space arranged to this end between the external wall of socket 2 and the internal wall of said cylindrical body 12*d*; an annular lug 16*a* of clip 16 is then embedded in a groove 12*e* arranged in cylindrical body 12*d* of sleeve 12 and stops the clip 16 from being retracted, the sleeve 12 thus having an external shape similar to that suggested as a first variation in FIG. 1. The tightening of socket 2 on threading 1*a* of water pipe 1 is no longer obtained, in this case, by means of a housing capable of receiving a tightening key, but is simply provided with two holes 17 at the front of socket 2, opposite which two peripheral holes 14 of perforated outlet plate 12*a* of sleeve 12 can be brought, a stop device, not represented in the drawings, then being able to be introduced through holes 14 and 17, placed to coincide such that the rotation of the sleeve 12 drives the rotation of internal socket 2, which can thus be screwed on water pipe 1.

The shower device described previously can also be provided with a protective envelope, not represented in the drawings for reasons of clarity of the latter, only the end of sleeve 12 being visible.

The field of invention is that of sprinkling devices adapted notably to equip showers.

I claim:

1. Sprinkling device for a shower adapted to be positioned at an outlet of a water pipe, comprising:

a socket capable of being connected to an outlet of a water pipe, said socket having a first inner chamber, and a second inner chamber extending below said first inner chamber, said second inner chamber exiting to an outlet for a water jet;

a calibrated nozzle associated with said outlet;

a deflector element for providing a swirling movement to water passing through said socket and exiting said nozzle, said deflector element being positioned in said first inner chamber and comprising a central spindle having a downstream end, a plurality of peripheral vanes connected to said central spindle, each of said plurality of peripheral vanes having a scallop promoting regrouping of swirling jets of water along said central spindle, and a tip at said downstream end of said central spindle for reconstituting the swirling jet into a single central swirling jet; and an adjustable spray angle element comprising a sleeve movably mounted on said socket, said sleeve including a perforated outlet plate positioned on an end of said sleeve associated with said nozzle.

2. The sprinkling device according to claim 1, wherein said perforated outlet plate comprises a larger, central opening surrounded by a plurality of smaller, peripheral openings.

3. The sprinkling device according to claim 1, wherein said socket is grooved to define annular notches, and annular grasping elements associated with said sleeve are capable of successively engaging said annular notches.

4. The sprinkling device according to claim 1, wherein said socket includes external threads, and annular grasping elements associated with said sleeve are capable of engaging said threads.

5. The sprinkling device according to claim 1, comprising a strainer upstream of said nozzle.

6. The sprinkling device according to claim 5, wherein said strainer comprises a sealing joint for the water pipe and said socket.

7. The sprinkling device according to claim 1, wherein said first inner chamber is cylindrical and said second inner chamber is conical.

8. The sprinkling device according to claim 1, wherein said perforated outlet plate comprises a larger, central opening surrounded by a plurality of smaller, peripheral openings, and said adjustable spray angle element has a retracted position wherein said plurality of smaller, peripheral openings are blocked.

9. The sprinkling device according to claim 8, wherein said adjustable spray angle element is adjustable to a first intermediate position wherein the water jet exiting said nozzle substantially reaches said smaller, peripheral openings.

10. The sprinkling device according to claim 9, wherein said adjustable spray angle element is adjustable to a second intermediate position wherein the water jet exiting said nozzle reaches said smaller, peripheral openings without hitting an internal wall of said sleeve.

11. The sprinkling device according to claim 10, wherein said adjustable spray angle element is adjustable through progressive positions past said second intermediate position wherein the water jet exiting said nozzle hits said internal wall of said sleeve progressively decreasing the force of the water jet.

12. The sprinkling device according to claim 1, wherein said deflector element is mounted with a slight longitudinal clearance in said first inner chamber.

13. The sprinkling device according to claim 1, wherein said perforated outlet plate has a sufficient thickness and is of a dimension effective to act as a guide for the water jet emanating from said nozzle.

14. Sprinkling device for a shower adapted to be positioned at an outlet of a water pipe, comprising:

a socket capable of being connected to an outlet of a water pipe, said socket having a first inner chamber, and a second inner chamber extending below said first inner chamber, said second inner chamber exiting to an outlet for a water jet;

a calibrated nozzle associated with said outlet;

a deflector element for providing a swirling movement to water passing through said socket and exiting said nozzle, said deflector element being positioned in said first inner chamber and comprising a central spindle having a downstream end, a plurality of peripheral vanes connected to said central spindle; and a adjustable spray angle element comprising a sleeve movably mounted on said socket, said sleeve including an internal wall and a perforated outlet plate positioned on an end of said sleeve associated with said nozzle, said perforated outlet plate comprising a larger, central opening surrounded by a plurality of smaller, peripheral openings, said adjustable spray angle element having a retracted position wherein said plurality of smaller, peripheral openings are blocked.

15. The sprinkling device according to claim 1, wherein said central spindle includes a longitudinal bore forming a tube for passage of a central, non-swirling flow of water feeding into a central portion of the swirling jet.

16. The sprinkling device according to claim 14, wherein said first inner chamber and said second inner chamber are cylindrical.

17. The sprinkling device according to claim 14, said adjustable spray angle element is adjustable to a first intermediate position wherein the water jet exiting said nozzle substantially reaches said smaller, peripheral openings.

18. The sprinkling device according to claim 17, said adjustable spray angle element is adjustable to a second intermediate position wherein the water jet exiting said nozzle reaches said smaller, peripheral openings without hitting said internal wall of said sleeve.

19. The sprinkling device according to claim 18, said adjustable spray angle element is adjustable through progressive positions past said second intermediate position wherein the water jet exiting said nozzle hits said internal wall of said sleeve progressively decreasing the force of the water jet.

20. The sprinkling device according to claim 14, wherein said perforated outlet plate has a sufficient thickness and is of a dimension effective to act as a guide for the water jet emanating from said nozzle.

* * * * *